US009790936B2

(12) United States Patent
Yamamoto et al.

(10) Patent No.: US 9,790,936 B2
(45) **Date of Patent: *Oct. 17, 2017**

(54) VARIABLE DISPLACEMENT SWASH PLATE COMPRESSOR

(71) Applicant: KABUSHIKI KAISHA TOYOTA JIDOSHOKKI, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP); Masaki Ota, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 329 days.

This patent is subject to a terminal disclaimer.

(21) Appl. No.: 14/666,759

(22) Filed: Mar. 24, 2015

(65) Prior Publication Data

US 2015/0275879 A1 Oct. 1, 2015

(30) Foreign Application Priority Data

Mar. 28, 2014 (JP) ..... 2014-070178

(51) Int. Cl.
*F04B 1/26* (2006.01)
*F04B 27/20* (2006.01)
(Continued)

(52) U.S. Cl.
CPC ..... *F04B 27/20* (2013.01); *F04B 27/0804* (2013.01); *F04B 27/1054* (2013.01);
(Continued)

(58) Field of Classification Search
CPC ..... F04B 27/1054; F04B 27/1804; F04B 27/1072; F04B 27/1063; F04B 27/0804; F04B 2027/1813; F04B 2027/1886
(Continued)

(56) References Cited

U.S. PATENT DOCUMENTS 4,037,993 A 7/1977 Roberts
4,061,443 A 12/1977 Black et al.
(Continued)

FOREIGN PATENT DOCUMENTS

CN 103807132 5/2014
CN 103807134 5/2014
(Continued)

OTHER PUBLICATIONS

Official Action, along with English-language translation thereof, for CN Appl. No. 201510133583 dated Aug. 17, 2016.
(Continued)

*Primary Examiner* — Charles Freay

(74) *Attorney, Agent, or Firm* — Greenblum & Bernstein, P.L.C.

(57) ABSTRACT

A variable displacement swash compressor includes a housing, a drive shaft, a swash plate, a link mechanism, a piston, a conversion mechanism, an actuator, and a control mechanism. The swash plate is rotatable together with the drive shaft in a swash plate chamber. The conversion mechanism reciprocates the piston in a cylinder bore. The actuator is operative to change the inclination angle of the swash plate. The actuator is rotatable integrally with the drive shaft. The actuator includes a partitioning body, a movable body, and a control pressure chamber. The control mechanism changes the pressure of the control pressure chamber to move the movable body. The movable body and the link mechanism are located at opposite sides of the swash plate.

14 Claims, 6 Drawing Sheets

(51) Int. Cl.
*F04B 27/08* (2006.01)
*F04B 27/10* (2006.01)
*F04B 27/18* (2006.01)

(52) U.S. Cl.
CPC ..... *F04B 27/1063* (2013.01); *F04B 27/1072* (2013.01); *F04B 27/1804* (2013.01); *F04B 2027/1813* (2013.01); *F04B 2027/1886* (2013.01)

(58) Field of Classification Search
USPC ..... 92/12.2
See application file for complete search history.

(56) References Cited

U.S. PATENT DOCUMENTS

| | | | | |
|---|---|---|---|---|
| 4,174,191 | A | 11/1979 | Roberts | |
| 4,606,705 | A | 8/1986 | Parekh | |
| 4,884,952 | A | 12/1989 | Kanamaru et al. | |
| 4,946,350 | A | 8/1990 | Suzuki et al. | |
| 4,963,074 | A * | 10/1990 | Sanuki | F04B 27/18 417/222.1 |
| 5,032,060 | A * | 7/1991 | Kobayashi | F04B 27/12 417/222.1 |
| 5,186,475 | A | 2/1993 | Kawai et al. | |
| 5,259,736 | A * | 11/1993 | Terauchi | F01B 3/106 417/222.1 |
| 5,370,503 | A | 12/1994 | Terauchi | |
| 5,636,973 | A | 6/1997 | Sonobe et al. | |
| 5,871,337 | A | 2/1999 | Fukanuma et al. | |
| 6,077,047 | A | 6/2000 | Nagai et al. | |
| 6,126,405 | A | 10/2000 | Kawaguchi et al. | |
| 6,135,722 | A | 10/2000 | Kawaguchi et al. | |
| 6,139,282 | A | 10/2000 | Ota et al. | |
| 6,149,398 | A | 11/2000 | Fukanuma et al. | |
| 6,158,968 | A | 12/2000 | Nakamura | |
| 6,227,812 | B1 | 5/2001 | Kawaguchi et al. | |
| 6,250,891 | B1 | 6/2001 | Kawaguchi et al. | |
| 6,379,120 | B1 | 4/2002 | Adaniya et al. | |
| 6,520,751 | B2 | 2/2003 | Fujita et al. | |
| 6,546,742 | B1 | 4/2003 | Ota et al. | |
| 6,848,262 | B2 | 2/2005 | Nosaka | |
| 6,957,604 | B1 | 10/2005 | Tiedemann et al. | |
| 7,530,797 | B2 | 5/2009 | Ito et al. | |
| 7,841,839 | B2 | 11/2010 | Inoue et al. | |
| 8,596,994 | B2 | 12/2013 | Taguchi | |
| 9,228,576 | B2 | 1/2016 | Yamamoto et al. | |
| 9,228,577 | B2 | 1/2016 | Yamamoto et al. | |
| 9,309,874 | B2 | 4/2016 | Yamamoto et al. | |
| 9,309,875 | B2 * | 4/2016 | Yamamoto | F04B 27/1804 |
| 9,316,217 | B2 * | 4/2016 | Yamamoto | F04B 27/1804 |
| 9,429,147 | B2 | 8/2016 | Suzuki et al. | |
| 9,506,459 | B2 | 11/2016 | Ota et al. | |
| 2002/0006339 | A1 | 1/2002 | Ota et al. | |
| 2003/0223887 | A1 * | 12/2003 | Kawano | F04B 27/1072 417/269 |
| 2004/0062660 | A1 | 4/2004 | Kazahaya et al. | |
| 2009/0107327 | A1 | 4/2009 | Ota et al. | |
| 2014/0127042 | A1 | 5/2014 | Yamamoto et al. | |
| 2014/0127045 | A1 | 5/2014 | Yamamoto et al. | |
| 2014/0294613 | A1 | 10/2014 | Suzuki et al. | |
| 2014/0294614 | A1 | 10/2014 | Ota et al. | |
| 2015/0285234 | A1 | 10/2015 | Nakaima et al. | |

FOREIGN PATENT DOCUMENTS

| | | |
|---|---|---|
| EP | 2728186 | 5/2014 |
| EP | 2784316 | 10/2014 |
| JP | 52-131204 | 11/1977 |
| JP | 62-225782 | 10/1987 |
| JP | 62-247184 | 10/1987 |
| JP | 2-19665 | 1/1990 |
| JP | 5-172052 | 7/1993 |
| JP | 10-246181 | 9/1998 |
| JP | 4378190 | 12/2009 |
| KR | 10-1992-0021904 | 12/1992 |
| WO | 2014/069618 | 5/2014 |

OTHER PUBLICATIONS

Official Action, along with English-language translation thereof, for CN Appl. No. 201510133584.4 dated Aug. 2, 2016.
Official Action for CN Appl. No. 201510134293.7 dated Aug. 17, 2016.
U.S. Appl. No. 14/666,846 to Kazunari Honda et al., filed Mar. 24, 2015.
U.S. Appl. No. 14/666,860 to Shinya Yamamoto et al., filed Mar. 24, 2015.
U.S. Appl. No. 14/666,819 to Shinya Yamamoto et al., filed Mar. 24, 2015.
U.S. Appl. No. 14/666,639 to Shinya Yamamoto et al., filed Mar. 24, 2015.
U.S. Appl. No. 14/666,688 to Shinya Yamamoto et al., filed Mar. 24, 2015.
Search Report for EP Pat. App. No. 15160832.0 dated Nov. 13, 2015.
Extended European Search Report for EP App. No. 15160831.2 dated Nov. 13, 2015.
Extended European Search Report for EP App. No. 15160830.4 dated Nov. 13, 2015.
Extended European Search Report for EP App. No. 15160833.8 dated Nov. 13, 2015.
Official Action issued in U.S. Appl. No. 14/666,688 dated Jan. 27, 2017.
Official Action issued in U.S. Appl. No. 14/666,846 dated Feb. 6, 2017.
Official Action issued in U.S. Appl. No. 14/666,860 dated Feb. 9, 2017.
Official Action issued in U.S. Appl. No. 14/666,819 dated Mar. 24, 2017.
Official Action issued in U.S. Appl. No. 14/666,639 dated Apr. 6, 2017.

* cited by examiner

Up
Down
Front
Rear
O
1
3
3a
3b
3c
3d
3e
5
5a
5b
7
9
9a
9b
9c
11a
11b
13
13a
13b
13c
15c, 15d
17
17a
19
21
21a
21b
21c
21d
23
23a
23b
23c
23d
25
27a
27b
29a
29b
31
33
35a
35b
37a
37b
39
39a
39b
39c
41
41a
41b
41c
43
43a
43b
45
45a
45b
47a
47b
47c
49
49a
51a
51b
51c
130a
130b
130c
330
M1
M2
M3

VARIABLE DISPLACEMENT SWASH PLATE COMPRESSOR

BACKGROUND OF THE INVENTION

The present invention relates to a variable displacement swash plate compressor.

Japanese Laid-Out Patent Publication Nos. 5-172052 and 52-131204 describe conventional variable displacement swash plate compressors (hereafter simply referred to as the compressors). The compressors each have a housing including a suction chamber, a discharge chamber, a swash plate chamber, and a plurality of cylinder bores. A rotatable drive shaft is supported in the housing. A swash plate that is rotatable together with the drive shaft is arranged in the swash plate chamber. A link mechanism is located between the drive shaft and the swash plate to allow the inclination angle of the swash plate to change. The inclination angle refers to an angle relative to a direction orthogonal to the rotation axis of the drive shaft. Each cylinder bore accommodates a piston. The piston reciprocates in the cylinder bore and defines a compression chamber in the cylinder bore. A conversion mechanism coverts rotation of the swash plate to reciprocation of the piston in each cylinder bore. The stroke when the piston reciprocates is in accordance with the inclination angle of the swash plate. The inclination angle of the swash plate is changed by an actuator, which is controlled by a control mechanism.

The compressor described in Japanese Laid-Out Patent Publication No. 5-172052 includes a pressure regulation chamber in a rear housing member, which is an element of the housing, and a control pressure chamber in a cylinder block, which is also an element of the housing. The control pressure chamber is in communication with the pressure regulation chamber. The actuator is located in the control pressure chamber. The actuator is not rotated integrally with the drive shaft. More specifically, the actuator includes a non-rotation movable body that covers the rear end of the drive shaft. The non-rotation movable body includes an inner wall surface that supports the rear end of the drive shaft so that the rear end is rotatable. The non-rotation movable body is movable along the rotation axis of the drive shaft. Although the non-rotation movable body moves in the control pressure chamber along the rotation axis of the drive shaft, the non-rotation movable body is not allowed to rotate about the rotation axis of the drive shaft. A spring that urges the non-rotation movable body toward the front is arranged in the control pressure chamber. The actuator includes a movable body, which is coupled to the swash plate and movable along the rotation axis of the drive shaft. A thrust bearing is arranged between the non-rotation movable body and the movable body. A pressure control valve, which changes the pressure of the control pressure chamber, is arranged between the pressure regulation chamber and the discharge chamber. A change in the pressure of the control pressure chamber moves the non-rotation movable body and the movable body in the axial direction of the drive shaft.

A link mechanism includes a movable body and a lug arm, which is fixed to the drive shaft. The rear end of the lug arm includes an elongated hole, which extends in a direction orthogonal to the rotation axis of the drive shaft and in a direction extending from the radially outer side toward the rotation axis of the drive shaft. The front of the swash plate is supported by a pin inserted to the elongated hole so that the swash plate is pivotal about a first pivot axis. The front end of the movable body includes an elongated hole, which extends in a direction orthogonal to the rotation axis of the drive shaft and in a direction extending from the radially outer side toward the rotation axis. The rear end of the swash plate is supported by a pin inserted to the elongated hole so that the swash plate is pivotal about a second pivot axis, which is parallel to the first pivot axis.

In this compressor, the pressure control valve opens to connect the discharge chamber and the pressure regulation chamber so that the pressure of the control pressure chamber becomes higher than that of the swash plate chamber. This moves the non-rotation movable body and the movable body toward the front. Thus, the inclination angle of the swash plate increases, the piston stroke is lengthened, and the compression displacement is increased for each rotation of the drive shaft. When the pressure control valve closes to disconnect the discharge chamber and the pressure regulation chamber, the pressure of the control pressure chamber becomes low and about the same as that of the swash plate chamber. This moves the non-rotation movable body and the movable body toward the rear. Thus, the inclination angle of the swash plate decreases, the piston stroke is shortened, and the compressor displacement is decreased for each rotation of the drive shaft.

In the compressor of Japanese Laid-Open Patent Publication No. 52-131204, the actuator is rotatable integrally with the drive shaft in the swash plate chamber. More specifically, the actuator includes a partitioning body fixed to the drive shaft. The partitioning body accommodates a movable body, which is movable relative to the partitioning body along the rotation axis. A control pressure chamber is defined between the partitioning body and the movable body to move the movable body with the pressure of the control pressure chamber. A communication passage, which is in communication with the control pressure chamber, extends through the drive shaft. A pressure control valve is arranged between the communication passage and the discharge chamber. The pressure control valve is configured to change the pressure of the control pressure chamber and move the movable body relative to the partitioning body along the rotation axis. The movable body includes a rear end that is in contact with a hinge ball. The hinge ball pivotally couples the swash plate to the drive shaft. A spring, which urges the hinge ball in the direction that increases the inclination angle of the swash plate, is arranged at the rear end of the hinge ball.

A link mechanism includes the hinge ball and a link, which is located between the partitioning body and the swash plate. A pin, which extends in a direction orthogonal to the rotation axis, is inserted to the front end of the link. A pin, which also extends in a direction orthogonal to the rotation axis, is inserted to the rear end of the link. The swash plate is pivotally supported by the link and the two pins.

In this compressor, a pressure regulation valve opens to connect the discharge chamber and the pressure regulation chamber so that the pressure of the control pressure chamber becomes higher than that of the swash plate chamber. This moves the movable body toward the rear. Thus, the inclination angle of the swash plate decreases and shortens the stroke of the pistons. This decreases the compressor displacement for each rotation of the drive shaft. When the pressure regulation valve closes and disconnects the discharge chamber and the pressure regulation chamber, the pressure of the control pressure chamber becomes low and about the same as the swash plate chamber. This moves the movable body toward the front. Thus, the inclination angle of the swash plate increases and lengthens the stroke of the pistons. This increases the compressor displacement for each rotation of the drive shaft.

In the compressor of Japanese Laid-Open Patent Publication No. 5-172052, the non-rotation movable body of the actuator moves in the axial direction at the rear end of the drive shaft. This increases the overall axial length.

In this compressor, when rotation is produced at the inner circumferential surface of the non-rotation movable body, axial movement is produced at the inner circumferential surface and the outer circumferential surface of the compressor. This may result in insufficient lubrication around the non-rotation movable body and adversely affect the movement characteristics of the actuator. In such a case, it may become difficult to change the inclination angle of the swash plate adequately, and the compressor displacement may not be controlled in the preferred manner by lengthening and shortening the piston stroke. Further, in this compressor, wear or the like is apt to occur around the actuator. This may adversely affect the durability of the compressor.

In the compressor of Japanese Laid-Open Patent Publication No. 52-131204, the actuator is located closer to the rotation axis than the link of the link mechanism. Thus, the control pressure chamber of the actuator is small in the radial direction, and it is difficult to urge the swash plate with the movable body. Further, in this compressor, due to the link mechanism, it is difficult to supply the actuator with lubrication oil. This may result in insufficient lubrication of the actuator and adversely affect the movement characteristics of the actuator. Accordingly, it may become difficult to change the inclination angle of the swash plate, and the compressor displacement may not be controlled in the preferred manner.

SUMMARY OF THE INVENTION

It is an object of the present invention to provide a compact compressor having superior durability and capable of performing superior displacement control.

One aspect of the present invention is a variable displacement swash plate compressor including a housing, a drive shaft, a swash plate, a link mechanism, a plurality of pistons, a conversion mechanism, an actuator, and a control mechanism. The housing includes a suction chamber, a discharge chamber, a swash plate chamber, and a plurality of cylinder bores. The drive shaft is rotationally supported by the housing. The swash plate is rotatable together with the drive shaft in the swash plate chamber. The link mechanism is arranged between the drive shaft and the swash plate. The link mechanism allows for changes in an inclination angle of the swash plate relative to a direction orthogonal to a rotation axis of the drive shaft. The pistons are reciprocally accommodated in the cylinder bores respectively. The conversion mechanism reciprocates each piston in the cylinder bore with a stroke that is in accordance with the inclination angle of the swash plate when the swash plate rotates. The actuator is capable of changing the inclination angle of the swash plate. The control mechanism controls the actuator. The actuator is adapted to be rotatable integrally with the drive shaft. The actuator includes a partitioning body, which is loosely fitted to the drive shaft in the swash plate chamber, a movable body, which is coupled to the swash plate and movable relative to the partitioning body along the rotation axis, and a control pressure chamber, which is defined by the partitioning body and the movable body and moves the movable body by pressure of the control pressure chamber. The control mechanism is configured to change the pressure of the control pressure chamber to move the movable body. The movable body and the link mechanism are located at opposite sides of the swash plate.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE EMBODIMENTS

One embodiment of the present invention will now be described with reference to FIGS. 1 to 4. Compressors of the first to fourth embodiments are each installed in a vehicle to form a refrigeration circuit of a vehicle air conditioner.

First Embodiment

Figure 1:
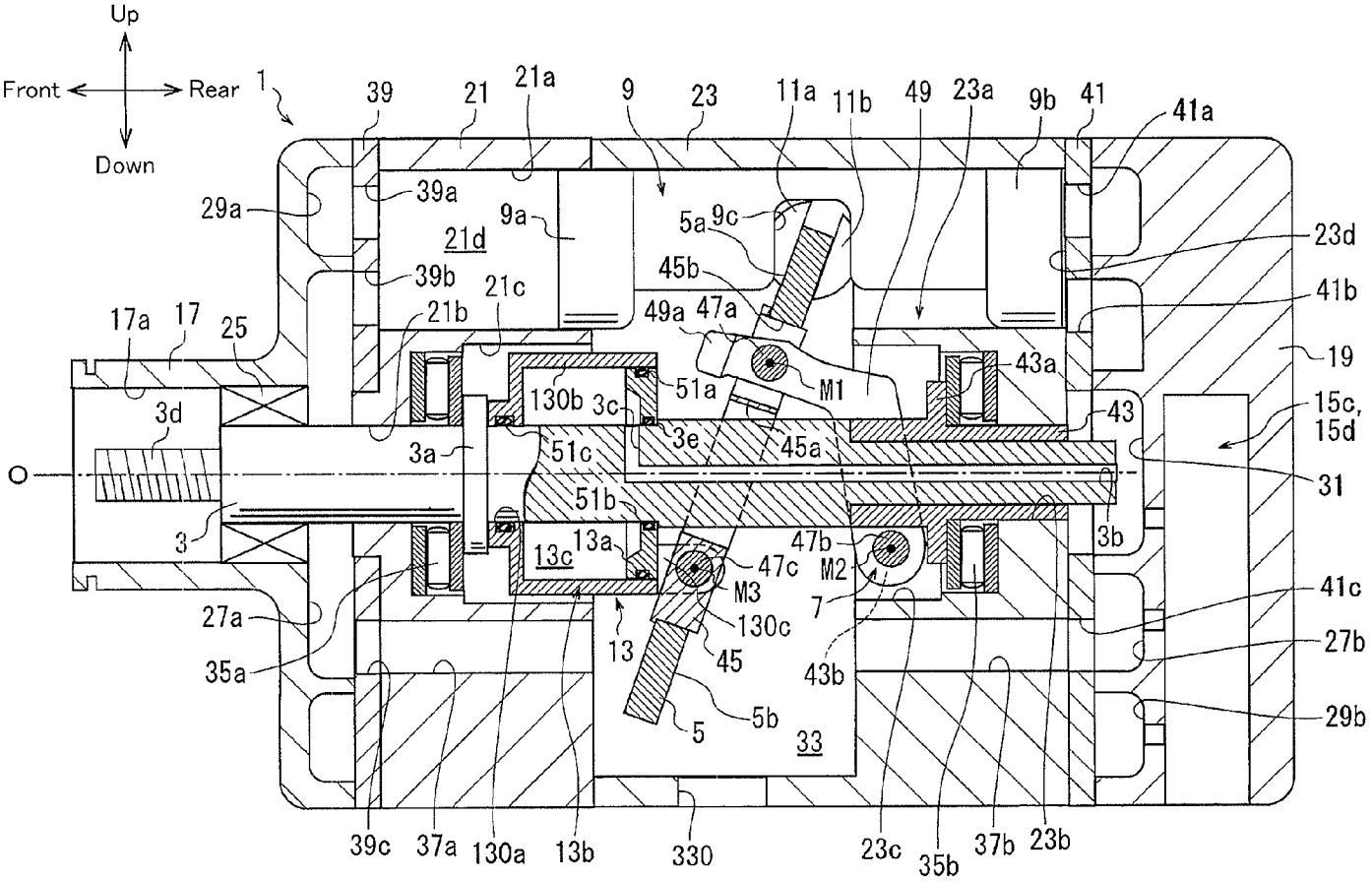
FIG. 1 is a cross-sectional view showing a compressor of first embodiment when the displacement is maximal.
Figure 2:
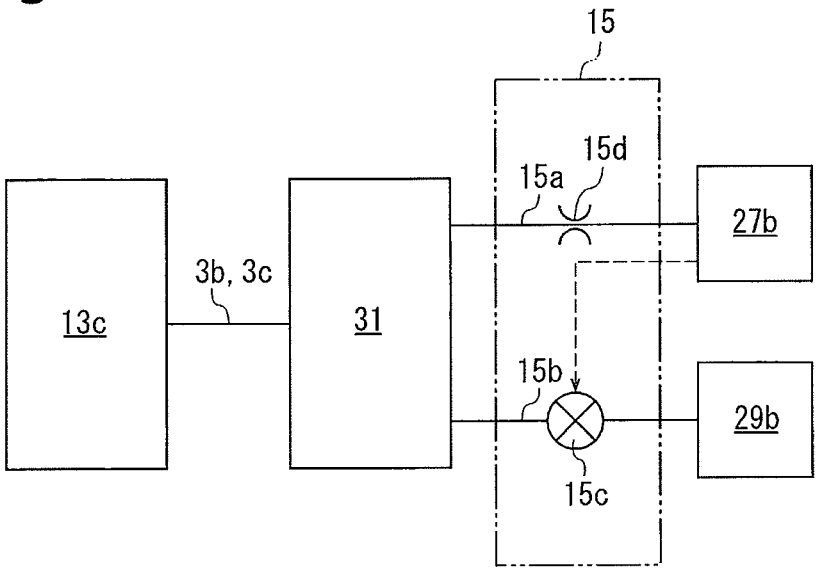
FIG. 2 is a schematic diagram showing a control mechanism in the compressor of first and third embodiments.
Figure 3:
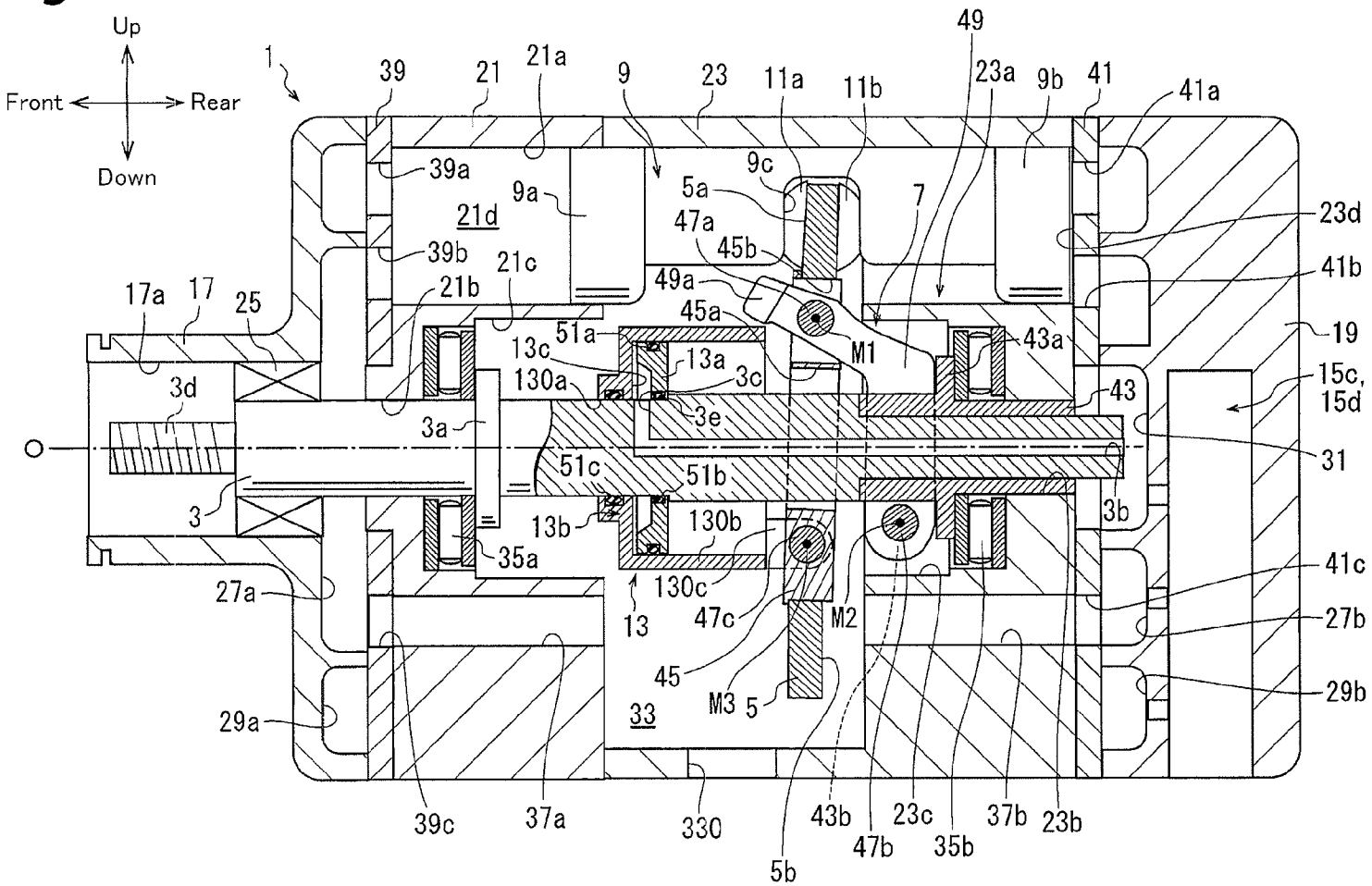
FIG. 3 is a cross-sectional view showing the compressor of first embodiment when the displacement is minimal.

Referring to FIGS. 1 and 3, a compressor of the first embodiment includes a housing 1, a drive shaft 3, a swash plate 5, a link mechanism 7, pistons 9, front and rear shoes 11*a* and 11*b*, an actuator 13, and a control mechanism 15, which is shown in FIG. 2. Each piston 9 is provided with a pair of the shoes 11*a* and 11*b*.

As shown in FIG. 1, the housing 1 includes a front housing member 17, which is located at the front of the compressor, a rear housing member 19, which is located at the rear of the compressor, and first and second cylinder blocks 21 and 23, which are located between the front housing member 17 and the rear housing member 19.

The front housing member 17 includes a boss 17*a*, which projects toward the front. A sealing device 25 is arranged in the boss 17*a* around the drive shaft 3. Further, the front housing member 17 includes a first suction chamber 27*a* and a first discharge chamber 29*a*. The first suction chamber 27*a* is located in a radially inner portion of the front housing member 17, and the first discharge chamber 29*a* is located in a radially outer portion of the front housing member 17.

The rear housing member 19 includes the control mechanism 15. The rear housing member 19 includes a second suction chamber 27*b*, a second discharge chamber 29*b*, and a pressure regulation chamber 31. The second suction chamber 27*b* is located in a radially inner portion of the rear housing member 19, and the second discharge chamber 29*b* is located in a radially outer portion of the rear housing member 19. The pressure regulation chamber 31 is located in a radially central portion of the rear housing member 19. A discharge passage (not shown) connects the first discharge chamber 29*a* and the second discharge chamber 29*b*. The discharge passage includes a discharge port, which is in communication with the outer side of the compressor.

A swash plate chamber 33 is defined in the first cylinder block 21 and the second cylinder block 23. The swash plate chamber 33 is located in a central portion of the housing 1.

The first cylinder block 21 includes first cylinder bores 21*a*, which are arranged at equal angular intervals in the circumferential direction and which extend parallel to one another. Further, the first cylinder block 21 includes a first shaft bore 21*b*. The drive shaft 3 extends through the first shaft bore 21*b*. The first cylinder block 21 also includes a first recess 21*c*, which is located at the rear side of the first shaft bore 21*b*. The first recess 21*c* is in communication with the first shaft bore 21*b* and coaxial with the first shaft bore 21*b*. Further, the first recess 21*c* is in communication with the swash plate chamber 33 and includes a stepped wall surface. A first thrust bearing 35*a* is arranged in a front portion of the first recess 21*c*. The first cylinder block 21 includes a first suction passage 37*a* that communicates the swash plate chamber 33 with the first suction chamber 27*a*.

In the same manner as the first cylinder block 21, the second cylinder block 23 includes second cylinder bores 23*a*. Further, the second cylinder block 23 includes a second shaft bore 23*b*. The drive shaft 3 extends through the second shaft bore 23*b*. The second shaft bore 23*b* is in communication with the pressure regulation chamber 31. The second cylinder block 23 also includes a second recess 23*c*, which is located at the front side of the second shaft bore 23*b*. The second recess 23*c* is in communication with the second shaft bore 23*b* and coaxial with the second shaft bore 23*b*. Further, the second recess 23*c* is in communication with the swash plate chamber 33 and includes a stepped wall surface. A second thrust bearing 35*b* is arranged in a rear portion of the second recess 23*c*. The second cylinder block 23 includes a second suction passage 37*b* that communicates the swash plate chamber 33 with the second suction chamber 27*b*.

The swash plate chamber 33 is connected to an evaporator (not shown) via a suction port 330 formed in the second cylinder block 23.

A first valve plate 39 is arranged between the front housing member 17 and the first cylinder block 21. The first valve plate 39 includes a suction port 39*b* and a discharge port 39*a* for each first cylinder bore 21*a*. A suction valve mechanism (not shown) is provided for each suction port 39*b*. Each suction port 39*b* communicates the corresponding first cylinder bore 21*a* with the first suction chamber 27*a*. A discharge valve mechanism (not shown) is provided for each discharge port 39*a*. Each discharge port 39*a* communicates the corresponding first cylinder bore 21*a* with the first discharge chamber 29*a*. The first valve plate 39 also includes a communication hole 39*c*. The communication hole 39*c* communicates the first suction chamber 27*a* with the swash plate chamber 33 through the first suction passage 37*a*.

A second valve plate 41 is arranged between the rear housing member 19 and the second cylinder block 23. In the same manner as the first valve plate 39, the second valve plate 41 includes a suction port 41*b* and a discharge port 41*a* for each second cylinder bore 23*a*. A suction valve mechanism (not shown) is provided for each suction port 41*b*. Each suction port 41*b* communicates the corresponding second cylinder bore 23*a* with the second suction chamber 27*b*. A discharge valve mechanism (not shown) is provided for each discharge port 41*a*. Each discharge port 41*a* communicates the corresponding second cylinder bore 23*a* with the second discharge chamber 29*b*. The second valve plate 41 also includes a communication hole 41*c*. The communication hole 41*c* communicates the second suction chamber 27*b* with the swash plate chamber 33 through the second suction passage 37*b*.

The first and second suction chambers 27*a* and 27*b* and the swash plate chamber 33 are in communication with one another through the first and second suction passages 37*a* and 37*b*. Thus, the first and second suction chambers 27*a* and 27*b* and the swash plate chamber 33 have substantially the same pressure. More accurately, the pressure of the swash plate chamber 33 is slightly higher than the pressure of the first and second suction chambers 27*a* and 27*b* due to the effect of blow-by gas. Refrigerant gas from the evaporator flows into the swash plate chamber 33 through the suction port 330. Thus, the pressure of each of the swash plate chamber 33 and the first and second suction chambers 27*a* and 27*b* is lower than the pressure of each of the first and second discharge chambers 29*a* and 29*b*. In this manner, the swash plate chamber 33 and the first and second suction chambers 27*a* and 27*b* define a low pressure chamber.

The swash plate 5, the actuator 13, and a flange 3*a* are arranged on the drive shaft 3. The drive shaft 3 is inserted through the boss 17*a* toward the rear and inserted to the first and second shaft bores 21*b* and 23*b* in the first and second cylinder blocks 21 and 23. The front end of the drive shaft 3 is located in the boss 17*a*, and the rear end is located in the pressure regulation chamber 31. The first and second shaft bores 21*b* and 23*b* support the drive shaft 3 in the housing 1 so that the drive shaft 3 is rotatable about the rotation axis O. The swash plate 5, the actuator 13, and the flange 3*a* are each located in the swash plate chamber 33. The flange 3*a* is located between the first thrust bearing 35*a* and the actuator 13, more specifically, between the first thrust bearing 35*a* and a movable body 13*b*. The flange 3*a* restricts contact of the first thrust bearing 35*a* and the movable body 13*b*. Radial bearings may be arranged between the drive shaft 3 and the walls of the first and second shaft bores 21*b* and 23*b*.

A support member 43 is fitted to the rear portion of the drive shaft 3. The support member 43 serves as a second member. The support member 43 includes a flange 43*a*, which is in contact with the second thrust bearing 35*b*, and a coupling portion 43*b*, which receives a second pin 47*b*. The drive shaft 3 includes an axial passage 3*b* and a radial passage 3*c*. The axial passage 3*b* extends through the drive shaft along the rotation axis O toward the front from the rear end of the drive shaft 3. The radial passage 3*c* extends from the front end of the axial passage 3*b* in the radial direction and opens in the outer surface of the drive shaft 3. The axial passage 3*b* and the radial passage 3*c* define a communication passage. The rear end of the axial passage 3*b* is opened to the pressure regulation chamber 31, or the low pressure chamber. The radial passage 3*c* is connected to a control pressure chamber 13*c*. Further, the drive shaft 3 includes a step 3*e*.

The swash plate 5 is an annular plate and includes a front surface 5*a* and a rear surface 5*b*. The front surface 5*a* of the swash plate 5 faces the front side of the compressor in the swash plate chamber 33. The rear surface 5*b* of the swash plate 5 faces the rear side of the compressor in the swash plate chamber 33. The swash plate 5 is fixed to a ring plate 45. The ring plate 45 serves as a first member. The ring plate 45 is an annular plate. An insertion hole 45*a* extends through the center of the ring plate 45. The drive shaft 3 is inserted to the insertion hole 45*a* to couple the swash plate 5 to the drive shaft 3 in the swash plate chamber 33.

The link mechanism 7 includes a lug arm 49. The lug arm 49 is arranged at the rear side of the swash plate 5 in the swash plate chamber 33 and located between the swash plate 5 and the support member 43. The lug arm 49 is generally L-shaped. As shown in FIG. 3, the lug arm 49 contacts the flange 43*a* of the support member 43 when the swash plate 5 is inclined relative to the direction orthogonal to the rotation axis O at the minimum angle. In the compressor, the lug arm 49 allows the swash plate 5 to be maintained at the minimum inclination angle. The distal end of the lug arm 49 includes a weight 49*a*. The weight 49*a* extends over one half of the circumference of the actuator 13. The weight 49*a* may be designed to have a suitable shape.

A first pin 47*a* couples the distal end of the lug arm 49 to a top region of the ring plate 45. Thus, the distal end of the lug arm 49 is supported by the ring plate 45, or the swash plate 5, so that the lug arm 49 is pivotal about the axis of the first pin 47*a*, namely, a first pivot axis M1. The first pivot axis M1 extends in a direction perpendicular to the rotation axis O of the drive shaft 3.

A second pin 47*b* couples a basal end of the lug arm 49 to the support member 43. Thus, the basal end of the lug arm 49 is supported by the support member 43, or the drive shaft 3, so that the lug arm 49 is pivotal about the axis of the second pin 47*b*, namely, a second pivot axis M2. The second pivot axis M2 extends parallel to the first pivot axis M1. The lug arm 49 and the first and second pins 47*a* and 47*b* correspond to the link mechanism 7 of the present invention.

In the compressor, the link mechanism 7 couples the swash plate 5 and the drive shaft 3 so that the swash plate 5 rotates together with the drive shaft 3. The lug arm 49 has the distal end and the basal end that are respectively pivotal about the first pivot axis M1 and the second pivot axis M2 so that inclination angle of the swash plate 5 is changed.

The weight 49*a* extends along the distal end of the lug arm 49, that is, on the side opposite to the second pivot axis M2 with respect to the first pivot axis M1. The lug arm 49 is supported by the first pin 47*a* on the ring plate 45 so that the weight 49*a* is inserted through a groove 45*b* in the ring plate 45 and is located at the front side of the ring plate 45, that is, the front side of the swash plate 5. Rotation of the swash plate 5 around the rotation axis O generates centrifugal force that acts on the weight 49*a* at the front side of the swash plate 5.

Each piston 9 includes a front end that defines a first piston head 9*a* and a rear end that defines a second piston head 9*b*. The first piston head 9*a* is reciprocally accommodated in the corresponding first cylinder bore 21*a* defining a first compression chamber 21*d*. The second piston head 9*b* is reciprocally accommodated in the corresponding second cylinder bore 23*a* defining a second compression chamber 23*d*. Each piston 9 includes a recess 9*c*, which accommodates the semispherical shoes 11*a* and 11*b*. The shoes 11*a* and 11*b* convert the rotation of the swash plate 5 to the reciprocation of the piston 9. The shoes 11*a* and 11*b* correspond to a conversion mechanism of the present invention. In this manner, the first and second piston heads 9*a* and 9*b* are reciprocal in the first and second cylinder bores 21*a* and 23*a* with a stroke that is in accordance with the inclination angle of the swash plate 5.

The actuator 13 is located in front of the swash plate 5 in the swash plate chamber 33 and is movable into the first recess 21*c*. The actuator 13 includes a partitioning body 13*a* and a movable body 13*b*.

The partitioning body 13*a* is disk-shaped and loosely fitted to the drive shaft 3 in the swash plate chamber 33. An O-ring 51*a* is arranged on the outer circumferential surface of the partitioning body 13*a*, and an O-ring 51*b* is arranged on the inner circumferential surface of the partitioning body 13*a*.

The movable body 13*b* is cylindrical and has a closed end. Further, the movable body 13*b* includes an insertion hole 130*a*, to which the drive shaft 3 is inserted, a main body portion 130*b*, which extends from the front of the movable body 13*b* toward the rear, and a coupling portion 130*c*, which is formed on the rear end of the main body portion 130*b*. An O-ring 51*c* is arranged in the insertion hole 130*a*. The movable body 13*b* is located between the first thrust bearing 35*a* and the swash plate 5.

The drive shaft 3 is inserted into the main body portion 130*b* of the movable body 13*b* and through the insertion hole 130*a*. The partitioning body 13*a* is arranged in a movable manner in the main body portion 130*b*. The movable body 13*b* is rotatable together with the drive shaft 3 and movable along the rotation axis O of the drive shaft 3 in the swash plate chamber 33. By inserting the drive shaft 3 into the main body portion 130*b*, the movable body 13*b* and the link mechanism 7 are located at opposite sides of the swash plate 5. The O-ring 51*c* is arranged in the insertion hole 130*a*. In this manner, the drive shaft 3 extends through the actuator 13, and the actuator 13 is rotatable integrally with the drive shaft 3 about the rotation axis O.

A third pin 47*c* couples a bottom region of the ring plate 45 to the coupling portion 130*c* of the movable body 13*b*. Thus, the ring plate 45, or the swash plate 5, is supported by the movable body 13*b* so as to be pivotal about the axis of the third pin 47*c*, namely, an action axis M3. The action axis M3 extends parallel to the first and second pivot axes M1 and M2. In this manner, the movable body 13*b* is coupled to the swash plate 5. By coupling the coupling portion 130*c* and the bottom region of the ring plate 45, the movable body 13*b* and the link mechanism 7 are located at opposite sides of the swash plate 5. More specifically, the movable body 13*b* faces the basal end of the lug arm 49, which is a portion of the link mechanism 7, at the opposite side of the swash plate 5. The movable body 13*b* contacts the flange 3*a* when the swash plate 5 is inclined at the maximum angle. In the compressor, the movable body 13*b* allows the swash plate 5 to be maintained at the maximum inclination angle.

The control pressure chamber 13*c* is defined between the partitioning body 13*a* and the movable body 13*b*. The radial passage 3*c* opens to the control pressure chamber 13*c*. The control pressure chamber 13*c* is in communication with the pressure regulation chamber 31 through the radial passage 3*c* and the axial passage 3*b*.

As shown in FIG. 2, the control mechanism 15 includes a bleed passage 15*a*, a gas supplying passage 15*b*, a control valve 15*c*, and an orifice 15*d*.

The bleed passage 15*a* is connected to the pressure regulation chamber 31 and the second suction chamber 27*b*. The pressure regulation chamber 31 is in communication with the control pressure chamber 13*c* through the axial passage 3*b* and the radial passage 3*c*. Thus, the control pressure chamber 13*c* and the second suction chamber 27*b* are in communication with each other through the bleed passage 15*a*. The bleed passage 15*a* includes the orifice 15*d*.

The gas supplying passage 15*b* is connected to the pressure regulation chamber 31 and the second discharge chamber 29*b*. Thus, in the same manner as the bleed passage 15*a*, the control pressure chamber 13*c* and the second discharge chamber 29*b* are in communication with each other through the axial passage 3*b* and the radial passage 3*c*. In this manner, the axial passage 3*b* and the radial passage 3*c* form portions of the bleed passage 15*a* and the gas supplying passage 15*b*, which serve as the control passage.

The control valve 15*c* is arranged in the gas supplying passage 15*b*. The control valve 15*c* is operative to adjust the open degree of the gas supplying passage 15*b* based on the pressure of the second suction chamber 27*b*. A known valve may be used as the control valve 15*c*.

The distal end of the drive shaft 3 includes a threaded portion 3*d*. The threaded portion 3*d* couples the drive shaft 3 to a pulley or an electromagnetic clutch (neither shown). A belt (not shown), which is driven by a vehicle engine, runs along the pulley or a pulley of the electromagnetic clutch.

A pipe leading to the evaporator is connected to the suction port 330. A pipe leading to a condenser is connected to a discharge port (none shown). The compressor, the evaporator, an expansion valve, the condenser, and the like form the refrigeration circuit of the vehicle air conditioner.

In the compressor, the rotation of the drive shaft 3 rotates the swash plate 5 and reciprocates each piston 9 in the corresponding first and second cylinder bores 21*a* and 23*a*. Thus, the volumes of the first and second compression chambers 21*d* and 23*d* change in accordance with the piston stroke. This draws refrigerant gas into the swash plate chamber 33 through the suction port 330 from the evaporator. The refrigerant gas flows through the first and second suction chambers 27*a* and 27*b* and is compressed in the first and second compression chambers 21*d* and 23*d*, which then discharge the refrigerant gas into the first and second discharge chambers 29*a* and 29*b*. The refrigerant gas in the first and second discharge chambers 29*a* and 29*b* is discharged out of the discharge port and sent to the condenser.

During operation of the compressor, centrifugal force, which acts to decrease the inclination angle of the swash plate, and compression reaction, which acts to decrease the inclination angle of the swash plate 5 through the pistons 9, are applied to the rotation members, which include the swash plate 5, the ring plate 45, the lug arm 49, and the first pin 47*a*. The compressor displacement may be controlled by changing the inclination angle of the swash plate 5 thereby lengthening or shortening the stroke of the pistons 9.

More specifically, in the control mechanism 15, when the control valve 15*c* shown in FIG. 2 decreases the open degree of the gas supplying passage 15*b*, the pressure of the control pressure chamber 13*c* becomes substantially equal to the pressure of the second suction chamber 27*b*. Thus, the centrifugal force and the compression reaction acting on the rotation members move the movable body 13*b* toward the rear. This contracts the control pressure chamber 13*c* and decreases the inclination angle of the swash plate 5.

As a result, referring to FIG. 3, the swash plate 5 pivots about the action axis M3 of the swash plate 5 and the two ends of the lug arm 49 respectively pivot about the first and second pivot axes M1 and M2 so that the lug arm 49 moves toward the support member 43. This shortens the stroke of the pistons 9 and decreases the compressor displacement for each rotation of the drive shaft 3. The inclination angle of the swash plate 5 in FIG. 3 is the minimum inclination angle of the compressor.

In the compressor, the centrifugal force acting on the weight 49*a* is applied to the swash plate 5. Thus, in the compressor, the swash plate 5 easily moves in the direction that decreases the inclination angle of the swash plate 5. Further, when the movable body 13*b* moves toward the rear along the rotation axis O of the drive shaft 3, the rear end of the movable body 13*b* is arranged at the inner side of the weight 49*a*. As a result, in the compressor, when the inclination angle of the swash plate 5 decreases, the weight 49*a* covers about one half of the rear end of the movable body 13*b*.

When the control valve 15*c* shown in FIG. 2 increases the open degree of the gas supplying passage 15*b*, the pressure of the control pressure chamber 13*c* becomes substantially equal to the pressure of the second discharge chamber 29*b*. Thus, the movable body 13*b* of the actuator 13 moves toward the front against the centrifugal force and the compression reaction acting on the rotation members. This expands the control pressure chamber 13*c* and increases the inclination angle of the swash plate 5.

As a result, referring to FIG. 1, the swash plate 5 pivots in the opposite direction about the action axis M3 of the swash plate 5 and the two ends of the lug arm 49 respectively pivot in the opposite direction about the first and second pivot axes M1 and M2 so that the lug arm 49 moves away from the support member 43. This lengthens the stroke of the pistons 9 and increases the compressor displacement for each rotation of the drive shaft 3. The inclination angle of the swash plate 5 in FIG. 1 is the maximum inclination angle of the compressor.

In the compressor, the actuator 13 is rotatable integrally with the drive shaft 3 in the swash plate chamber 33. The control pressure chamber 13*c* is defined between the partitioning body 13*a* and the movable body 13*b* of the actuator 13, which extends around the drive shaft 3. Thus, the compressor decreases the length of the actuator 13 in the direction extending along the rotation axis O, and the entire compressor is shortened in the axial direction.

Further, the partitioning body 13*a* and the movable body 13*b* of the actuator 13 rotate integrally with the drive shaft 3 in the compressor. This limits the occurrence of insufficient lubrication around the movable body 13*b* and allows the movability of the actuator 13 to be maintained at a high level in the compressor.

In particular, a fixed clearance is provided between the movable body 13*b* and the wall of the first recess 21*c*. Thus, the movable body 13*b* does not contact the first cylinder block 21 when the actuator 13 rotates and when the movable body 13*b* moves forward and rearward in the swash plate chamber 33. This limits the occurrence of wear around the actuator 13 in the compressor.

In the compressor, the movable body 13*b* and the lug arm 49 of the link mechanism 7 are located at opposite sides of the swash plate 5. This allows the control pressure chamber 13*c* of the actuator 13 to be enlarged in the radial direction so that the movable body 13*b* easily urges the swash plate 5. Thus, in the compressor, the inclination angle of the swash plate 5 is easily changed, and the compressor displacement may be controlled in a preferred manner by lengthening and shortening the stroke of the pistons 9.

Accordingly, the first embodiment realizes a compressor that is compact, has superior durability, and is capable of performing superior displacement control.

In particular, the partitioning body 13*a* is loosely fitted to the drive shaft 3 in the compressor. Thus, in the compressor, the movable body 13*b* is smoothly moved relative to the partitioning body 13*a*. This allows the movable body 13*b* to be moved in a preferred manner along the rotation axis O.

Further, the first pin 47*a* supports the distal end of the lug arm 49 on the top region of the swash plate 5 pivotally about the first pivot axis M1. The second pin 47*b* supports the basal end of the lug arm 49 on the drive shaft 3 pivotally about the second pivot axis M2. The third pin 47*c* supports the bottom region of the swash plate 5 pivotally about the action axis M3.

In this manner, the link mechanism 7 is simplified. This reduces the size of the link mechanism 7 which, in turn, reduces the size of the compressor. Further, the compressor is configured so that the lug arm 49 easily pivots, and the swash plate 5 is supported by the movable body 13*b* pivotally about the action axis M3. This allows the inclination angle of the swash plate 5 to be changed in a preferred manner by pivoting the lug arm 49.

Further, the lug arm 49 includes the weight 49*a*. Thus, the lug arm 49 easily pivots in the direction that decreases the inclination angle of the swash plate 5. This allows the compressor to control the compressor displacement in a preferred manner by lengthening and shortening the stroke of the pistons 9.

The ring plate 45 is coupled to the swash plate 5, and the drive shaft 3 is coupled to the support member 43. This facilitates the coupling of the swash plate 5 and the lug arm 49 and the coupling of the drive shaft 3 and the lug arm 49. Further, the drive shaft 3 is inserted to the insertion hole 45*a* of the ring plate 45. This facilitates the coupling of the rotatable swash plate 5 to the drive shaft 3.

The lug arm 49 allows the inclination angle of the swash plate 5 to be maintained at the minimum value. The movable body 13*b* allows the inclination angle of the swash plate 5 to be maintained at the maximum value.

Thus, the inclination angle of the swash plate 5 may be changed in a preferred manner between the maximum value and the minimum value. This allows the compressor displacement to be controlled in a preferred manner.

In the compressor, the first pivot axis M1 is configured by the first pin 47*a* arranged between the ring plate 45 and the lug arm 49. The second pivot axis M2 is configured by the second pin 47*b* arranged between the support member 43 and the lug arm 49. The action axis M3 is configured by the third pin 47*c* arranged between the ring plate 45 and the movable body 13*b*.

The first pin 47*a* supports the distal end of the lug arm 49 to be easily pivotal relative to the ring plate 45. In the same manner, the second pin 47*b* supports the basal end of the lug arm 49 to be easily pivotal relative to the support member 43. Further, the third pin 47*c* supports the swash plate 5 to be easily pivotal relative to the movable body 13*b*.

The first and second thrust bearings 35*a* and 35*b*, which support the drive shaft 3 rotationally relative to the housing 1, are arranged between the drive shaft 3 and the housing 1. The movable body 13*b* is located between the first and second thrust bearings 35*a* and 35*b*. Thus, the thrust force produced by the control pressure chamber 13*c* is received by the first and second thrust bearings 35*a* and 35*b*.

In the compressor, at least one of the suction chamber 27*b* and the swash plate chamber 33 serves as the low pressure chamber. The control mechanism 15 includes the control passages 15*a* and 15*b*, which connect the control pressure chamber 13*c* to at least one of the low pressure chamber and the discharge chamber 29*b*, and the control valve 15*c*, which allows for adjustment of the open degree of the control passages 15*a* and 15*b*. This allows the control mechanism 15 to control the actuator 13 with the pressure difference between the control pressure chamber 13*c* and the low pressure chamber or the pressure difference between the control pressure chamber 13*c* and the discharge chamber 29*b*.

The control passages 15*a* and 15*b* may be formed by the bleed passage 15*a*, which connects the control pressure chamber 13*c* and the low pressure chamber, and the gas supplying passage 15*b*, which connects the control pressure chamber 13*c* and the discharge chamber 29*b*. Preferably, the control valve 15*c* adjusts the open degree of the gas supplying passage 15*b*. In this case, the high pressure of the discharge chamber 29 promptly increases the control pressure chamber 13*c* to a high pressure so that the compressor displacement is promptly decreased.

Further, the control passages 15*a* and 15*b* may be formed by the bleed passage 15*a*, which connects the control pressure chamber 13*c* and the low pressure chamber, and the gas supplying passage 15*b*, which connects the control pressure chamber 13*c* and the discharge chamber 29*b*. Preferably, the control valve 15*c* adjusts the open degree of the gas supplying passage 15*b*. In this case, the low pressure of the low pressure chamber gradually decreases the control pressure chamber 13*c* to a low pressure to produce a preferred driving feel.

In the compressor, the first and second suction chambers 27*a* and 27*b* are in communication with the swash plate chamber 33 through the first and second suction passages 37*a* and 37*b*. Thus, the refrigerant gas drawn into the first and second suction chambers 27*a* and 27*b* flows into the swash plate chamber 33. This allows the drive shaft 3, the actuator 13, and the like to be cooled by the refrigerant gas. Further, in the compressor, lubrication is performed with the lubrication oil suspended in the refrigerant gas when moving the movable body 13*b* or the like in the swash plate chamber 33. This allows the movability of the actuator 13 to be maintained at a high level and restricts the occurrence of wear around the actuator 13.

The swash plate chamber 33 includes the suction port 330. Thus, the compressor reduces noise more effectively than when the refrigerant gas from the evaporator flows through the first and second suction chambers 27*a* and 27*b* and into the swash plate chamber 33.

In the control mechanism 15 of the compressor, the control pressure chamber 13*c* and the second suction chamber 27*b* are in communication through the bleed passage 15*a*, and the control pressure chamber 13*c* and the second discharge chamber 29*b* are in communication through the gas supplying passage 15*b*. Further, the control valve 15*c* allows for adjustment of the open degree of the gas supplying passage 15*b*. Accordingly, in the compressor, the high pressure of the second discharge chamber 29*b* readily increases the pressure of the control pressure chamber 13*c* to a high value so that the compressor displacement is readily increased.

Further, in the compressor, the swash plate chamber 33 is used as a refrigerant gas passage leading to the first and second suction chambers 27*a* and 27*b*. This has a muffler effect that reduces suction pulsation of the refrigerant gas and decreases noise of the compressor.

Second Embodiment

Figure 4:
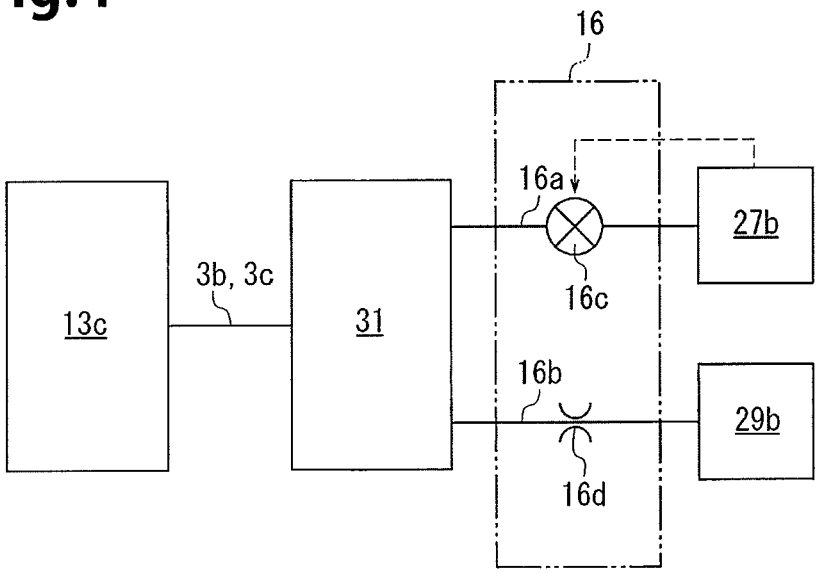
FIG. 4 is a schematic diagram showing a control mechanism in a compressor of second and fourth embodiments.

A compressor of the second embodiment includes a control mechanism 16 shown in FIG. 4 instead of the control mechanism 15 used in the compressor of the first embodiment. The control mechanism 16 includes a bleed passage 16*a*, a gas supplying passage 16*b*, a control valve 16*c*, and an orifice 16*d*. The bleed passage 16*a* and the gas supplying passage 16*b* form a control passage.

The bleed passage 16*a* is connected to the pressure regulation chamber 31 and the second suction chamber 27*b*. Thus, the control pressure chamber 13*c* and the second suction chamber 27*b* are in communication with each other through the bleed passage 16*a*. The gas supplying passage 16*b* is connected to the pressure regulation chamber 31 and the second discharge chamber 29*b*. Thus, the control pressure chamber 13*c* and the pressure regulation chamber 31 are in communication with the second discharge chamber 29*b* through the gas supplying passage 16*b*. The gas supplying passage 16*b* includes the orifice 16*d*.

The control valve 16*c* is arranged in the bleed passage 16*a*. The control valve 16*c* adjusts the open degree of the bleed passage 16*a* based on the pressure of the second suction chamber 27*b*. In the same manner as the control valve 15*c*, a known valve may be used as the control valve 16*c*. Further, the axial passage 3*b* and the radial passage 3*c* form portions of the bleed passage 16*a* and the gas supplying passage 16*b*. Other portions of the compressor have the same structure as the compressor of the first embodiment. Same reference numerals are given to those components that are the same as the corresponding components of the first embodiment. Such components will not be described in detail.

In the control mechanism 16 of the compressor, when the control valve 16*c* decreases the open degree of the bleed passage 16*a*, the pressure of the control pressure chamber 13*c* becomes substantially equal to the pressure of the second discharge chamber 29*b*. Thus, the movable body 13*b* of the actuator 13 moves toward the front against the centrifugal force and the compression reaction acting on the rotation members. This expands the control pressure chamber 13*c* and increases the inclination angle of the swash plate 5.

As a result, in the same manner as the compressor of the first embodiment, the inclination angle of the swash plate 5 increases in the compressor and lengthens the stroke of the pistons 9. This increases the compressor displacement for each rotation of the drive shaft 3 (refer to FIG. 1).

As shown in FIG. 4, when the control valve 16*c* increases the open degree of the bleed passage 16*a*, the pressure of the control pressure chamber 13*c* becomes substantially equal to the pressure of the second suction chamber 27*b*. Thus, the centrifugal force and the compression reaction acting on the rotation members move the movable body 13*b* toward the rear. This contracts the control pressure chamber 13*c* and decreases the inclination angle of the swash plate 5.

As a result, the inclination angle of the swash plate 5 decreases in the compressor and shortens the stroke of the pistons 9. This decreases the compressor displacement for each rotation of the drive shaft 3 (refer to FIG. 3).

In the control mechanism 16 of the compressor, the control valve 16*c* allows for adjustment of the open degree of the bleed passage 16*a*. Thus, in the compressor, the low pressure of the second suction chamber 27*b* gradually decreases the pressure of the control pressure chamber 13*c* to a low value so that a suitable driving feel of the vehicle is maintained. Otherwise, the operation of the compressor is the same as the compressor of the first embodiment.

Third Embodiment

Figure 5:
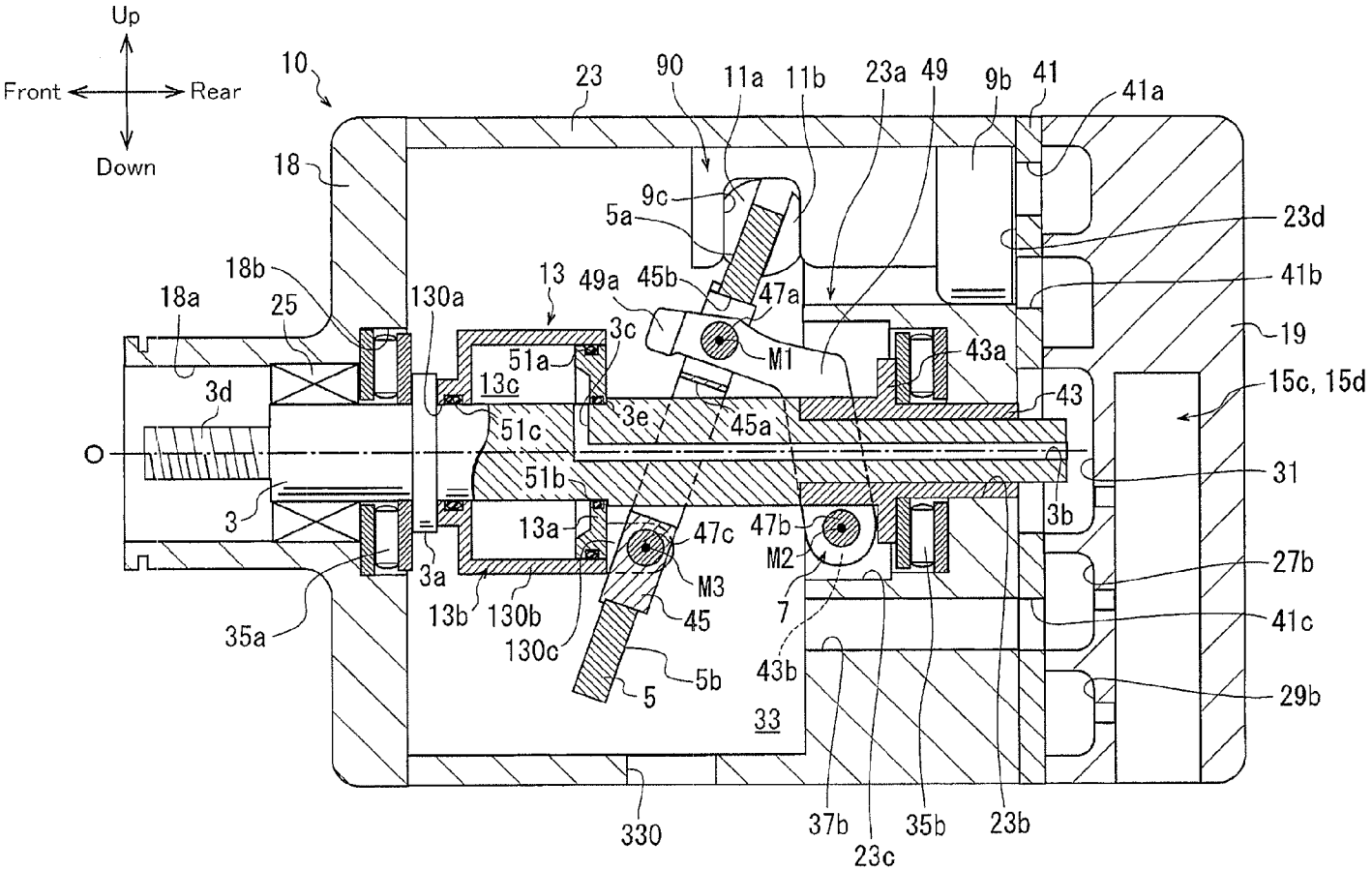
FIG. 5 is a cross-sectional view showing the compressor of third embodiment when the displacement is maximal.
Figure 6:
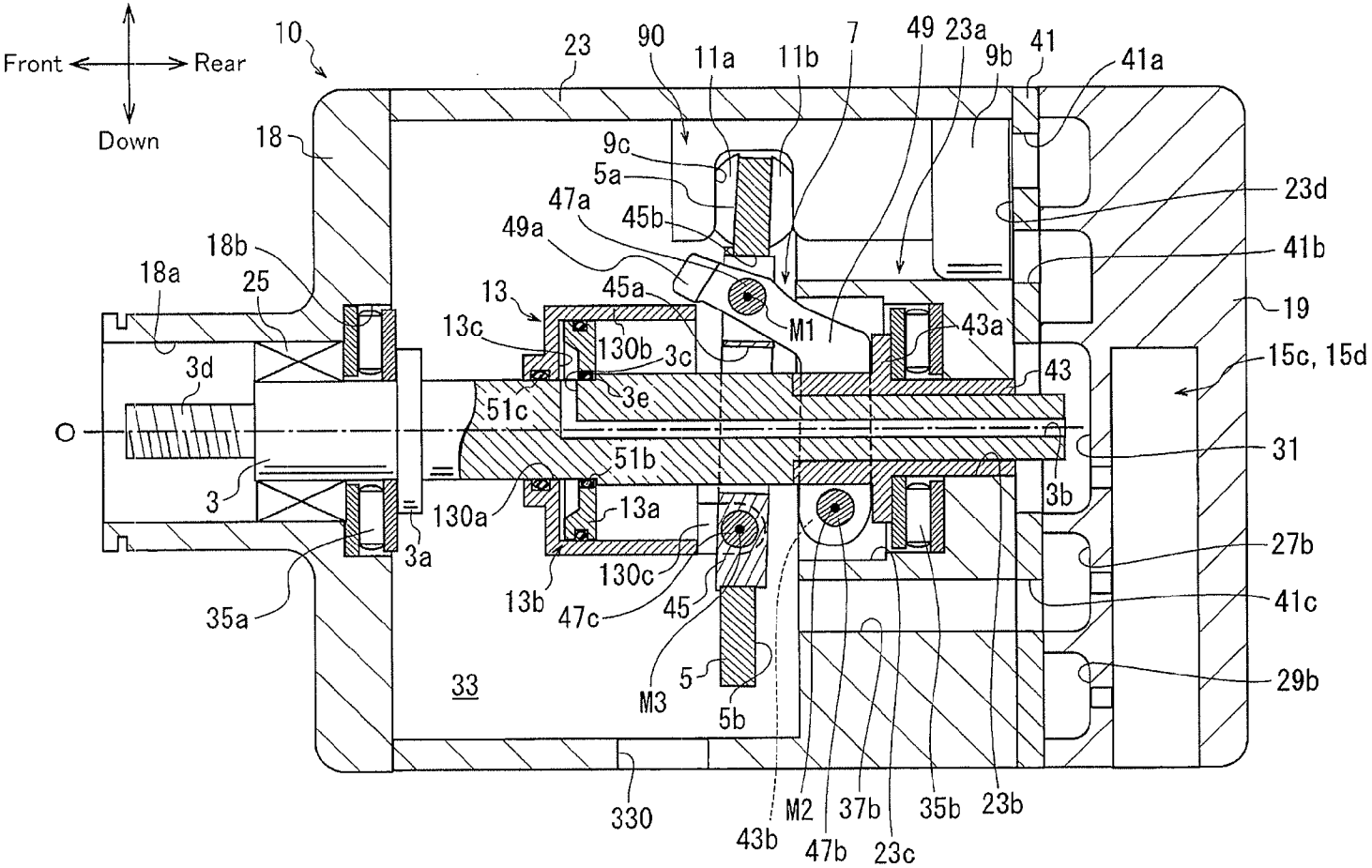
FIG. 6 is a cross-sectional view showing the compressor of third embodiment when the displacement is minimal.

Referring to FIGS. 5 and 6, a compressor of the third embodiment includes a housing 10 and pistons 90 instead of the housing 1 and the pistons 9 used in the compressor of the first embodiment.

The housing 10 includes a front housing member 18, a rear housing member 19 similar to that of the first embodiment, and a second cylinder block 23 similar to that of the first embodiment. The front housing member 18 includes a boss 18*a*, which extends toward the front, and a recess 18*b*. A sealing device 25 is arranged in the boss 18*a*. The front housing member 18 differs from the front housing member 17 of the first embodiment in that the front housing member 18 does not include the first suction chamber 27*a* and the first discharge chamber 29*a*.

In the compressor, a swash plate chamber 33 is defined in the front housing member 18 and the second cylinder block 23. The swash plate chamber 33, which is located in the middle portion of the housing 10, is in communication with the second suction chamber 27*b* through a second suction passage 37*b*. A first thrust bearing 35*a* is arranged in a recess 18*b* of the front housing member 18.

The pistons 90 differ from the pistons 9 of the first embodiment in that each piston includes only one piston head 9*b*, which is formed on the rear end. Otherwise, the structure of the piston 90 and the compressor is the same as the first embodiment. To facilitate description of the third embodiment, the second cylinder bores 23*a*, the second compression chambers 23*d*, the second suction chamber 27*b*, and the second discharge chamber 29*b* will be referred to as the cylinder bores 23*a*, the compression chambers 23*d*, the suction chamber 27*b*, and the discharge chamber 29*b*, respectively.

In the compressor, the rotation of the drive shaft 3 rotates the swash plate 5 and reciprocates the pistons 90 in the corresponding cylinder bores 23*a*. The volume of the compression chambers 23*d* changes in accordance with the piston stroke. Refrigerant gas from the evaporator is drawn through the suction port 330 into the swash plate chamber 33. The refrigerant gas is then drawn through the suction chamber 27*b*, compressed in each compression chamber 23*d*, and discharged into the discharge chamber 29*b*. Then, the refrigerant gas is discharged out of the discharge chamber 29*b* from a discharge port (not shown) toward the evaporator.

In the same manner as the compressor of the first embodiment, the compressor changes the inclination angle of the swash plate 5 to control the compressor displacement by lengthening and shortening the stroke of the pistons 90.

Referring to FIG. 6, when the stroke of the pistons 90 is shortened, the compression displacement decreases for each rotation of the drive shaft 3. The inclination angle of the swash plate 5 shown in FIG. 6 is the minimum inclination angle of the compressor.

Referring to FIG. 5, when the stroke of the pistons 90 is lengthened, the compression displacement increases for each rotation of the drive shaft 3. The inclination angle of the swash plate 5 shown in FIG. 5 is the maximum inclination angle of the compressor.

The compressor does not include the first cylinder block 21 and the like. This simplifies the structure in comparison with the compressor of the first embodiment. Thus, the compressor may be further reduced in size. Other advantages of the compressor are the same as the compressor of the first embodiment.

Fourth Embodiment

A compressor of the fourth embodiment includes the control mechanism 16 of FIG. 4 in the compressor of the third embodiment. The advantages of the compressor are the same as the second and third embodiments.

The present invention is not restricted to the first to fourth embodiments described above. It should be apparent to those skilled in the art that the present invention may be embodied in many other specific forms without departing from the spirit or scope of the invention. Particularly, it should be understood that the present invention may be embodied in the following forms.

In the compressors of the first to fourth embodiments, refrigerant gas is drawn into the first and second suction chambers 27*a* and 27*b* through the swash plate chamber 33. Instead, refrigerant gas may be directly drawn into the first and second suction chambers 27*a* and 27*b* from a pipe through a suction port. In this case, the first and second suction chambers 27*a* and 27*b* are in communication with the swash plate chamber 33 in the compressor, and the swash plate chamber 33 is configured to serve as a low pressure chamber.

The pressure regulation chamber 31 may be omitted from the compressors of the first to fourth embodiments.

The present examples and embodiments are to be considered as illustrative and not restrictive, and the invention is not to be limited to the details given herein, but may be modified within the scope and equivalence of the appended claims.

The invention claimed is:

1. A variable displacement swash plate compressor comprising:

a housing including a suction chamber, a discharge chamber, a swash plate chamber, and a plurality of cylinder bores;

a drive shaft rotationally supported by the housing;

a swash plate that is rotatable together with the drive shaft in the swash plate chamber;

a link mechanism arranged between the drive shaft and the swash plate, wherein the link mechanism allows for changes in an inclination angle of the swash plate relative to a direction orthogonal to a rotation axis of the drive shaft;

a plurality of pistons reciprocally accommodated in the cylinder bores respectively;

a conversion mechanism that reciprocates each piston in the cylinder bore with a stroke that is in accordance with the inclination angle of the swash plate when the swash plate rotates;

an actuator capable of changing the inclination angle of the swash plate; and a control mechanism that controls the actuator;

wherein the actuator is adapted to be rotatable integrally with the drive shaft;

the actuator includes a partitioning body, which is loosely fitted to the drive shaft in the swash plate chamber, a movable body, which is coupled to the swash plate and movable relative to the partitioning body along the rotation axis, and a control pressure chamber, which is defined by the partitioning body and the movable body and moves the movable body by pressure of the control pressure chamber;

the control mechanism is configured to change the pressure of the control pressure chamber to move the movable body; and the movable body and the link mechanism are located at opposite sides of the swash plate.

2. The variable displacement swash plate compressor according to claim 1, wherein the link mechanism includes a lug arm;

the lug arm includes a distal end that is supported by the swash plate pivotally about a first pivot axis, which is orthogonal to the rotation axis, and a basal end that is supported by the drive shaft pivotally about a second pivot axis, which is parallel to the first pivot axis;

the swash plate is supported by the movable body pivotally about an action axis, which is parallel to the first pivot axis and the second pivot axis.

3. The variable displacement swash plate compressor according to claim 2, wherein the lug arm includes a weight extending at an opposite side of the second pivot axis with respect to the first pivot axis, the weight is rotated about the rotation axis to apply force to the swash plate in a direction that decreases the inclination angle.

4. The variable displacement swash plate compressor according to claim 2, wherein the swash plate supports the distal end of the lug arm pivotally about the first pivot axis and includes a first member that is pivotal about the action axis, and the first member is annular and includes an insertion hole to which the drive shaft is inserted.

5. The variable displacement swash plate compressor according to claim 4, further comprising a second member fixed to the drive shaft, wherein the second member supports the basal end of the lug arm pivotally about the second pivot axis.

6. The variable displacement swash plate compressor according to claim 5, wherein at least one of the lug arm, the first member, and the second member is capable of maintaining the inclination angle at a minimum value.

7. The variable displacement swash plate compressor according to claim 1, wherein at least one of the partitioning body and the movable body is capable of maintaining the inclination angle at a maximum value.

8. The variable displacement swash plate compressor according to claim 5, wherein the first pivot axis is configured by a first pin arranged between the first member and the lug arm;

the second pivot axis is configured by a second pin arranged between the second member and the lug arm, and the action axis is configured by a third pin arranged between the first member and the movable body.

9. The variable displacement swash plate compressor according to claim 1, further comprising two thrust bearings arranged between the drive shaft and the housing, wherein the two thrust bearings support the drive shaft rotationally relative to the housing, and the movable body is located between the two thrust bearings.

10. The variable displacement swash plate compressor according to claim 1, wherein at least one of the suction chamber and the swash plate chamber is a low pressure chamber, and the control mechanism includes a control passage, which connects the control pressure chamber to at least one of the low pressure chamber and the discharge chamber, and a control valve, which is operative to adjust an open degree of the control passage.

11. The variable displacement swash plate compressor according to claim 10, wherein the control passage includes a bleed passage, which connects the control pressure chamber and the low pressure chamber, and a gas supplying passage, which connects the control pressure chamber and the discharge chamber; and the control valve adjusts the open degree of the gas supplying passage.

12. The variable displacement swash plate compressor according to claim 10, wherein the control passage includes a bleed passage, which connects the control pressure chamber and the low pressure chamber, and a gas supplying passage, which connects the control pressure chamber and the discharge chamber; and the control valve adjusts the open degree of the bleed passage.

13. The variable displacement swash plate compressor according to claim 1, further comprising a suction passage that connects the suction chamber and the swash plate chamber.

14. The variable displacement swash plate compressor according to claim 13, wherein the swash plate chamber includes a suction port connected to an evaporator.

* * * * *